United States Patent [19]

Tsukada

[11] 3,990,791

[45] Nov. 9, 1976

[54] IMAGE FORMING APPARATUS FOR FORMING POSITIVE AND NEGATIVE IMAGES

[75] Inventor: Syusei Tsukada, Tokyo, Japan

[73] Assignee: Canon Kabushiki Kaisha, Tokyo, Japan

[22] Filed: Feb. 13, 1975

[21] Appl. No.: 549,737

[30] Foreign Application Priority Data

Feb. 28, 1974 Japan ..... 49-23855

[52] U.S. Cl. ..... 355/3 R; 355/11; 355/14

[51] Int. Cl.[2] ..... G03G 15/052

[58] Field of Search ..... 355/3 R, 3 CH, 11, 14; 250/324–326; 317/3, 4, 262 AE; 96/1 C

[56] References Cited

UNITED STATES PATENTS

| | | | |
|---|---|---|---|
| 3,322,098 | 5/1967 | Pegram | 355/3 R |
| 3,615,395 | 10/1971 | Yamaji | 355/3 R |
| 3,761,171 | 9/1973 | Fields | 355/3 R |
| 3,844,653 | 10/1974 | Kelly | 355/8 |

*Primary Examiner*—L. T. Hix
*Assistant Examiner*—J. A. LaBarre
*Attorney, Agent, or Firm*—Fitzpatrick, Cella, Harper & Scinto

[57] ABSTRACT

In an image forming apparatus for selectively reproducing positive and negative electrostatic latent images corresponding to an original image, there is provided a photosensitive medium having an insulating layer on its surface, a first charger capable of uniformly imparting charges to the surface of the photosensitive medium, a second charger capable of acting on the photosensitive medium after the action of the first charger, projection apparatus for projecting the original image to expose the photosensitive medium to the image, a third charger open with respect to the projection-exposure of the original image by the projection apparatus and capable of acting on the photosensitive medium simultaneously therewith, a uniform exposure lamp for imparting uniform exposure to the photosensitive medium, and control circuitry for controlling the operations of the second and third chargers and the uniform exposure lamp.

7 Claims, 10 Drawing Figures

IMAGE FORMING APPARATUS FOR FORMING POSITIVE AND NEGATIVE IMAGES

BACKGROUND OF THE INVENTION

1. Field of the Invention

This invention relates to a method of and an apparatus for reproducing a negative or a positive image corresponding to an original image as desired, and more particularly to an image forming apparatus which, by simple construction, enables a positive electrostatic image and a negative electrostatic image corresponding to an optical image of an original to be selectively formed as a high contrast image on a photosensitive medium having an insulating layer on the surface thereof.

2. Description of the Prior Art

The need for selective reproduction of a negative and a positive image of an original image has been very great in machines such as reader-printers or the like. This is because, in reader-printers wherein the images recorded as negative or positive images on rolled film, fiche or the like are copied and reproduced, it would be highly convenient in using the copies if the negative images could be reproduced as positive images and the positive images could be reproduced as they were.

Nevertheless, the most prevailing print system for reader-printers which require compactness has been based on the silver salt photography method. However, the use of silver salt print paper could not provide positive print of an original image which may be negative or positive. Moreover, the quality of the printed image has been susceptible to variation with time, as a result of which the contrast of the printed image has been reduced or the image has been discolored. A further disadvantage is that the paper in use has been expensive special paper.

Further print systems heretofore proposed include the Fax system which uses photosensitive paper based on electrophotography, and the transfer system whereby an image formed on a photosensitive medium is transferred to ordinary paper.

In the Fax system, problems have been encountered in that the use of the special paper adds to the running costs and that relatively great thickness of the paper makes writing thereon difficult. Further, in order to selectively reproduce negative and positive images with this system, use must be made of Fax paper which has a bipolarity characteristic; that is, it has a photosensitive layer capable of retaining both positive and negative charges in the dark, wherein the charging polarity must be changed in accordance with the selection of the negative or the positive polarity for the image to be reproduced. This corresponds to the polarity of the toner in the developer and for example, when the toner in the developer is of negative polarity, the charging polarity is positive in case of the positive-positive reproduction, while the charging polarity is negative in case of negative-positive reproduction. However, the characteristic of such paper of opposite polarities is not sufficient at present and can only provide images of poor quality. On the other hand, the transfer system is very satisfactory in terms of image quality, as compared with the foregoing two systems, and does not suffer from any image degeneration due to aging. It also ensures low running costs. According to the transfer system, however, practical machines are designed exclusively for the reproduction of a positive image of an original or for the reproduction of a negative image of an original and, where image inversion is required, inversion development is effected by using a developer of the opposite polarity. As in the Fax system, change-over of the charging polarity is conceivable but in such case, the photosensitive medium is required to have bipolarity characteristic as in the previously described case. Thus, improvement of the characteristic of the photosensitive medium is imperative to provide good images of either polarity as is also the case with the Fax system.

Further, a high voltage source for applying voltages of positive and negative polarities to chargers will be needed in any Fax system and transfer system and this will unavoidably lead to an increase in the number of parts and higher costs, and the addition of such high voltage source is also undesirable. When the above-mentioned inversion development is to be carried out, replacement of the developer will be involved and this will necessitate the provision of a plurality of developing devices. In view of these considerations, the present invention provides a method and an apparatus which will achieve the objectives hereinafter described.

SUMMARY OF THE INVENTION

It is an object of the present invention to provide an image forming method which can easily reproduce a positive or a negative image corresponding to an original by a simple process change-over, and an apparatus therefore.

It is another object of the present invention to provide an image forming method which enables reproduction of a positive and a negative image by only one of the regular development devices using a monopolarity developer and inversion development, and an apparatus therefore.

It is still another object of the present invention to provide an image forming apparatus which permits good change-over between negative and positive image reproductions to be effected by a simple construction.

Briefly describing the present invention, when a positive image for an original is to be reproduced on a photosensitive medium having an insulating layer on the surface thereof, the photosensitive medium is charged with a predetermined polarity, whereafter it is subjected to charge of the opposite polarity or AC discharge while, at the same time, it is exposed to the optical image of the original, and then it is subjected to allover uniform exposure. Conversely, when a negative image for the original is to be reproduced, the photosensitive medium is charged with a predetermined polarity, whereafter it is only subjected to charge of the opposite polarity or AC discharge, and then exposed to the optical image of the original.

Other objects and features of the present invention will become fully apparent from the following detailed description taken in conjunction with the accompanying drawings.

BRIEF DESCRIPTION OF THE DRAWINGS

FIG. 2(A) is a graph illustrating the surface potential curve of the photosensitive medium during the positive image reproduction process shown in FIGS. 1-1 to 1-3.

FIG. 2(B) is a similar graph but illustrating the surface potential curve during the negative image reproduction process shown in FIGS. 1-1 and 1-4 to 1-5.

FIG. 3 illustrates a specific embodiment for carrying out the method of the present invention.

FIG. 4 is a partial illustration of a process change-over mechanism.

FIG. 5 is a partial illustration of another form of the process change-over mechanism.

DESCRIPTION OF THE PREFERRED EMBODIMENTS

FIGS. 1-1 to 1-5 illustrate the image formation process according to the present invention. The photosensitive medium, as shown there, has an outermost insulating layer and may preferably employ a photoconductive layer of the so-called injection type which is charged, for example, in the dark so that charges are introduced between the insulating layer and the photoconductive layer. Of course, a usual photconductive member may alternatively be employed which is charged in the light so that a charge layer is formed on the interface. In the specific embodiment shown herein, the photosensitive medium basically comprises a substratum 1, a photoconductive layer 2 and an insulating layer 3, as shown. The substratum 1 is usually conductive and may generally consist of tin, copper, aluminum or the like. The photoconductive layer 2 may usually be formed by coating or evaporation. The material therefor may be, for example, CdS, CdSe, Se, ZnO, ZnS, Se—Te, PbO or the like, and the most popular material is either a combination comprising resin-bound CdS applied by coating on a base plate or a combination comprising Se—Te applied by evaporation on a base plate of aluminum. The insulating layer 3 may be formed of a material such as polyester resin, polyethylene resin, fluorine resin or the like which is of high wear resistance and transparent and has a high electrical resistance to retain sufficient charges.

Figure 1:
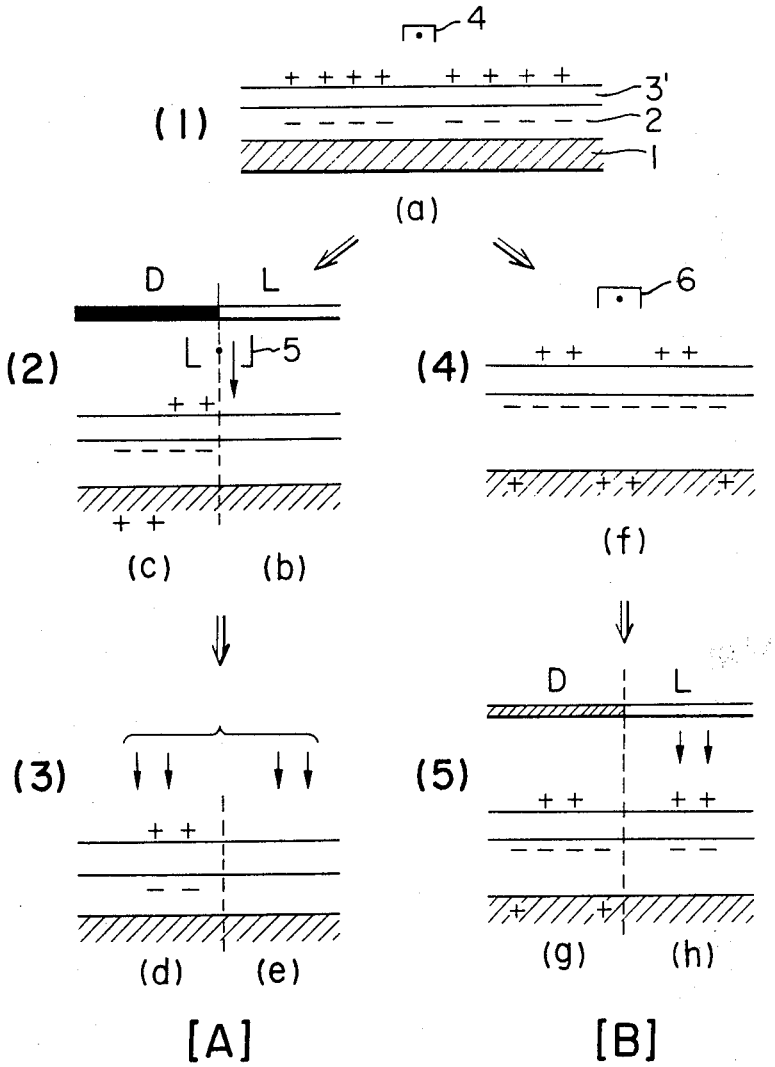
FIGS. 1-1 to 1-5 schematically illustrate the image formation process of the present invention with respect to a case where an N-type photosensitive medium is used, FIGS. 1-2 and 1-3 referring to the positive image reproduction process and FIGS. 1-4 and 1-5 referring to the negative image reproduction process.

Description will now be made of the process of the present invention using such a photosensitive medium. First, the surface of the insulating layer of the photosensitive medium is charged, for example, with positive polarity by a corona charger 4, whereby negative charges are introduced in the direction from the conductive substance and seized in the interface between the photoconductive layer 2 and the insulating layer 3 or in a portion of the photoconductive layer which is near the insulating layer. The polarity of these charges will be positive (+) if the photoconductive layer is an N-type semiconductor, and negative (−) if the photoconductive layer is a P-type semiconductor. FIG. 1-1 shows the charge distribution during the first charging step.

Figure 2:
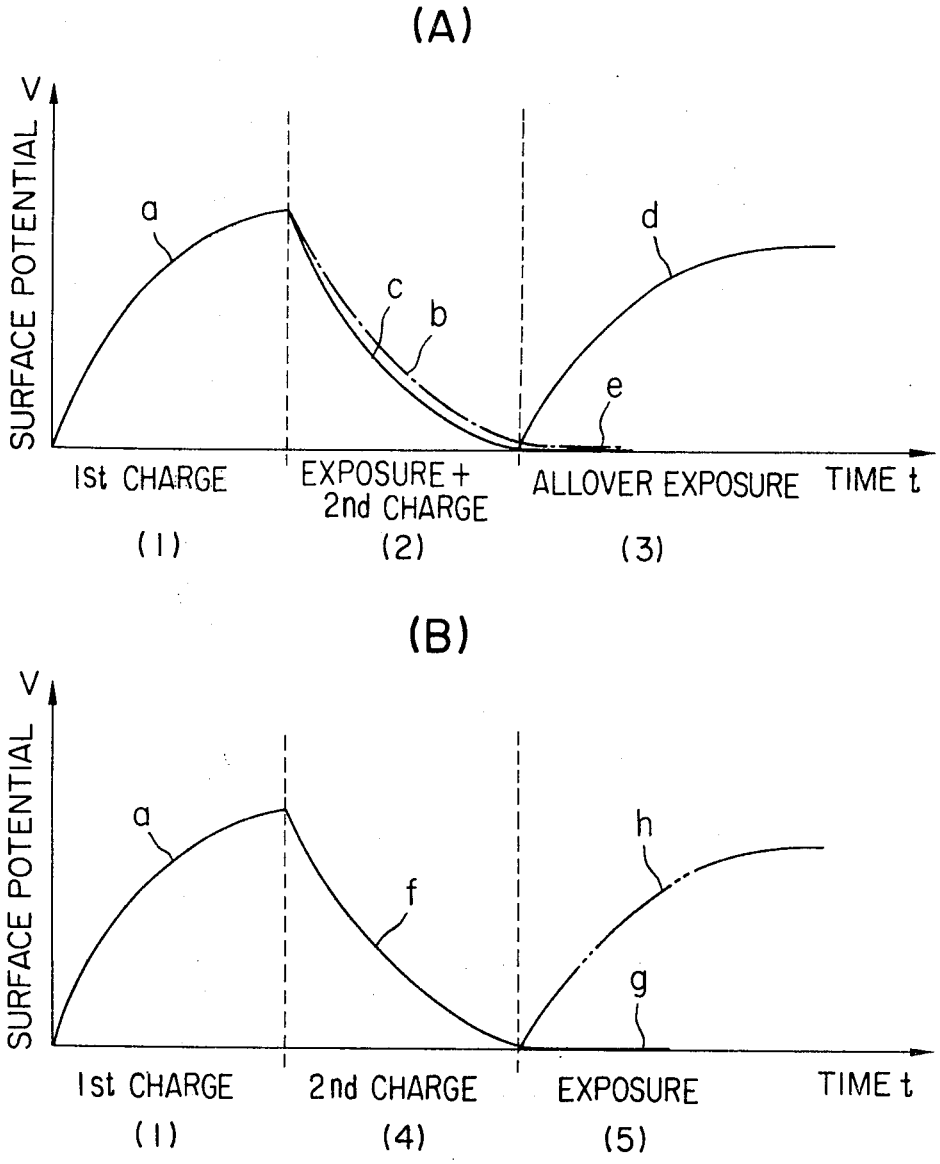

Subsequently, an optical image having a pattern of light L and dark D is applied to the photosensitive medium while, at the same time, AC corona is imparted thereto from an AC corona discharger or a charger of the opposite polarity, designated by 5 (FIG. 1-2). In the portion exposed to the light L, most of the positive charges disappear. The rate of disappearance depends on the time and intensity of the discharging. In this case, the negative charges seized in the vicinity of the photoconductive layer and the insulating layer are freed and decreased with the decreasing positive charges, and most of them are emitted into the substratum. Such charge distribution is shown at (b). On the other hand, in the dark portion which is not exposed to the light, the positive charges are decreased by the AC corona discharge but the rate of the decrease is less than that in the light portion. This is believed to be attributable to the action of an electric field resulting from the negative charges seized in or near the interface between the insulating layer and the photoconductive layer.

If the ratio of capacity of the photoconductive layer to the insulating layer is 1:1, the surface potential of the photosensitive medium will be zero with half of the positive surface charges induced in the substratum. Such condition is shown at (c). In the next step shown in FIG. 1-3, when the surface of the photosensitive medium is uniformly irradiated by an allover exposure lamp 8, the light portion remains unchanged, as indicated at (e), while in the dark portion the charges so far applied to the photoconductive layer are decreased to exhibit the charge distribution as indicated at (d), and this portion acts as an extraneous field. Thus, in this process, the dark portion assumes high potential. The surface potential curve in this process is graphically illustrated in FIG. 2(A).

In the second latent image formation process B, AC corona discharge is imparted to the dark portion of the photosensitive medium after the positive charging of FIG. 1-1. (See FIG. 1-4). The charge distribution shown there is the same as that in the dark portion (c) during the previous process A.

After completion of the AC discharge, the photosensitive medium is irradiated with image light (FIG. 1-5). At this time, the light portion (h) exhibits the same charge distribution as that shown in (c) of the previous process A.

Thus, during this latent image formation process B, the light portion (h) assumes high potential and the surface potential curve in this process is graphically illustrated in FIG. 2(B).

By the shift from the latent image formation process A to the latent image formation process B as described, negative and positive images corresponding to an original image may easily be provided.

Development of each of the so formed latent images by the use of the same developer will now be explained.

If each of the latent images formed by the above-described processes is developed with toner of the negative polarity, the latent image formed by the process A will become a positive image representing the original image because the toner adheres to the dark portion, whereas the latent image formed by the process B will become a negative-to-positive inverted image because the light portion (h) is at high potential. In the developing step for the present process, however, there is carried out a conventional development wherein toner adheres to the portion of high potential as described above.

If toner of the opposite polarity is used, both latent images will be inversion-developed but the same result will be obtained in that any negative or positive image may be provided by using the developer of the same polarity.

Figure 3:
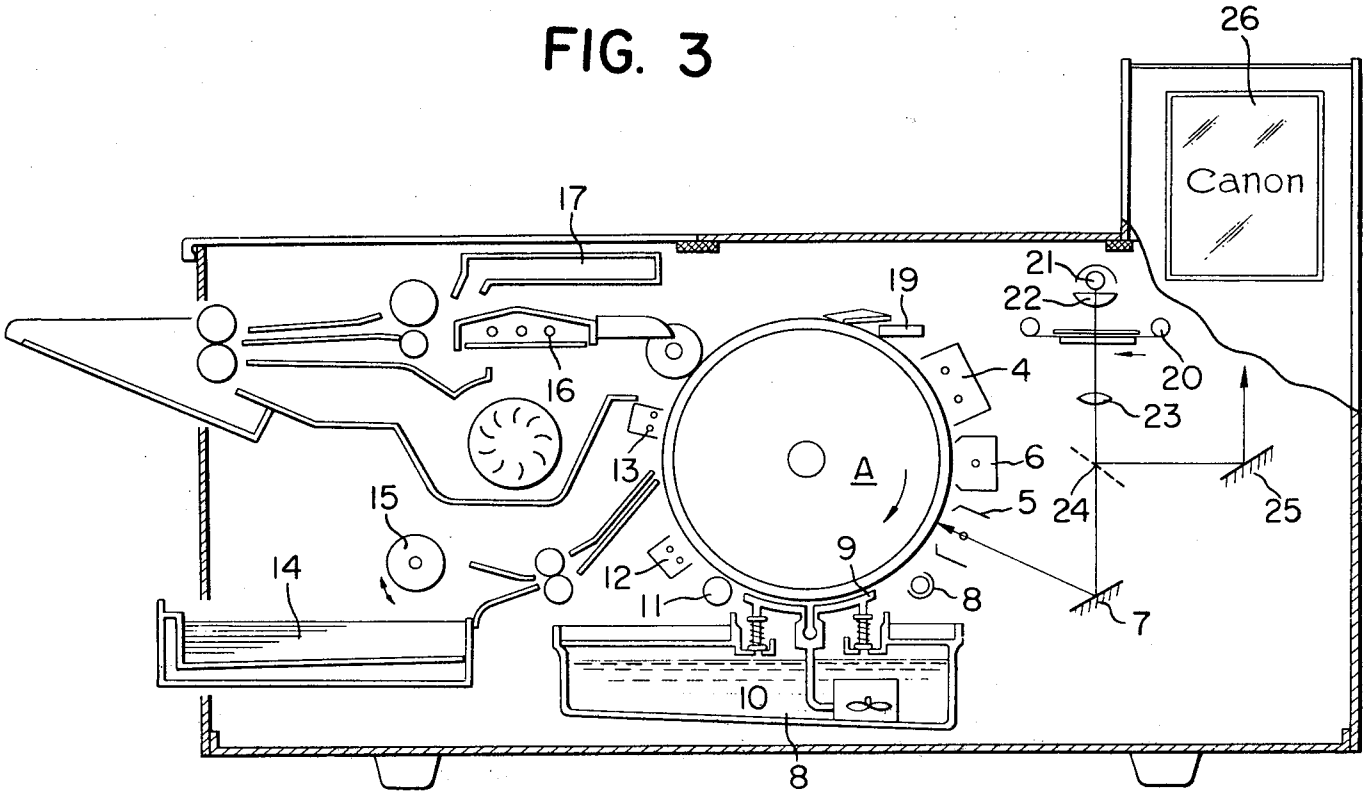
Figure 4:
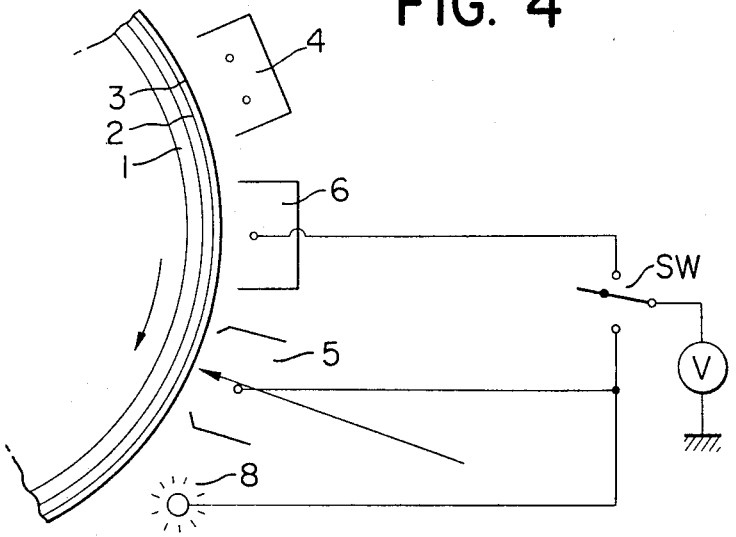

FIG. 3 shows an embodiment of the apparatus according to the present invention. In this embodiment, primary charger 4, discharger 5 formed with an optical opening, discharger 6 and allover exposure light source 8 are arranged adjacent the photosensitive mechanism A in the manner as shown. As shown in FIG. 4 which is a partial illustration including a control circuit, the dischargers 5 and 6 may be changed over in operation by a changeover switch SW, whereby change-over may be accomplished between the processes A and B. In response to the change-over switch, the allover exposure light source 8 is also turned on and off.

In the present arrangement, shift of the switch SW to its contact for operating the discharger 5 and the allover exposure light source 8 will accomplish the process A and shift of the switch SW to the opposite contact will accomplish the process B.

The apparatus shown in FIG. 3 is designed as a reader-printer, wherein an original such as rolled microfilm 20 or the like may be illuminated by a light source 21 through a condenser lens 22 and the optical image thereof is projected through a lens 23 and via a half-mirror 24 and a mirror 25 onto a screen 26 for search. If it is desired to obtain a copy of a desired original during the search, the above-described processes may be selectively effected on the photosensitive drum A. For example, the discharger 6 is deenergized and the primary charging by the charger 4 and the discharging by the discharger 5 are effected while, at the same time, application of the optical image is effected, whereafter allover exposure is effected by the allover exposure light source 8 to thereby form a latent image having a high potential across the dark portion thereof. On the other hand, if the discharger 5 and the allover exposure light source 8 are deenergized, there will be formed a latent image having high potential across the light portion thereof. Where CdS is used for the photoconductive layer, the primary charging is effected with positive polarity. Where Se-Te alloy is used, the primary charging is effected with negative polarity. In the shown example, liquid development was employed as the means for developing the latent images into visible ones. Where regular development is employed and if the primary charging is of negative polarity, then a developing liquid of positive polarity will be used. In such case, the reproduced image resulting from the above-described process will be a positive image of the original. Where inversion development is employed, the developer used will be of the same polarity as the primary charge. In the latter case, the developing electrode 9 may have a bias applied thereto, but an electrically insulated condition, i.e. what is called the self-bias development, is more common. A distance of about 1.5 mm between the surface of the photosensitive medium and the electrode 9 is preferable in terms of self-bias effect and half-tone reproduction. With such arrangement and by using a developing liquid 10 consisting chiefly of stylene resin and carbon (penetrating density of approximately 20 percent), there was provided a print density of 1.0 or greater for a developing time of about 0.3 second. An electrode roller 11 serves to eliminate any fog on the photosensitive drum when developed, and also to squeeze out any excess liquid thereon. Ground or a bias potential may be applied to that roller.

After completion of the developing step but prior to the image transfer step, the photosensitive drum A is uniformly subjected to corona discharge from a corona discharger 12. The corona causes the toner on the photsensitive drum to be covered with charges of the opposite polarity to the corona, and the developing liquid remaining on the photosensitive drum (usually aliphatic hydrocarbon) is interrupted by the corona so that any excess developing liquid is squeezed out. By varying the intensity of the corona discharge in accordance with the type of transfer paper, proper image transfer may be accomplished and the load to the fixation and drying of the transfer paper may also be governed. It is generally desirable that the polarity of the corona discharge be the same as that of the developing liquid.

After the squeezing step, transfer paper 14 is fed to the photosensitive drum A by a feed roller 15 and brought into contact therewith. Discharge from a transfer corona discharger 13 (of the opposite polarity to the squeeze corona) is applied to the paper from the back thereof so that the toner on the photosensitive drum is transferred to the transfer paper 14. Having the image so transferred thereto, the transfer paper is separated from the photosensitive drum A, and then fixed and dried by the actions of a heat-fixing plate 16 and drying wind 17, whereafter the paper is discharged onto a discharge tray.

In the meantime, any amount of the toner which has not been transferred from the drum to the paper is cleared by a blade 19 so that the photosensitive drum is usable for another image formation. Also, the latent image forming means which selectively carries out the above-described processes A and B is changed over while the bias applied to the developing electrode 9 or the electrode roller 11 is controlled and the amount of corona discharge of the squeeze charger 12 or the transfer charger 13 is also controlled, whereby any of those processes may be effected to provide a print under optimum conditions.

Figure 5:
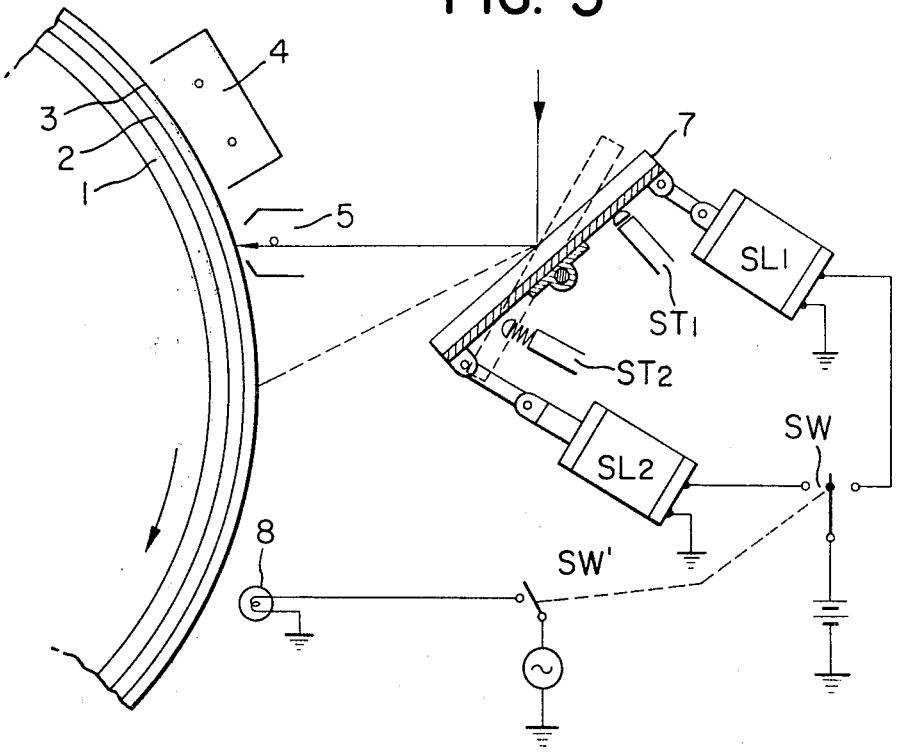

FIG. 5 is a partial illustration of another embodiment. The arrangement shown in FIG. 5 is of the type in which the optical system is changed over. As shown, there are disposed in the direction of movement of the photosensitive medium a primary charger 4 and a discharger 5 formed with an optical opening, and a mirror 7 of the optical system. The mirror is pivotally mounted for throwing an optical image. By varying the set angle of the mirror, exposure may be effected either through the opening of the discharger 5 or behind the discharger 5.

The angle of the mirror 7 may be set by changing over a switch SW to energize solenoid SL1 or SL2 which causes pivotal movement of the mirror 7, and such movement may be limited by stop ST1 or ST2, as shown in FIG. 5.

Arrangements may of course be made such that the allover exposure light source 8 is also turned on and off in response to the change-over of the switch SW. More specifically, when the solenoid SL1 is energized and the position of the mirror 7 is set by the stop ST1, exposure may occur simultaneously with the operation of the discharger 5 to thereby carry out the process A previously described. Also, if the switch SW is changed over to energize the solenoid SL2, the mirror 7 will pivot in the opposite direction and be set by the stop ST2. In the latter case, exposure occurs behind the discharger 5 to carry out the process B previously described.

As has specifically been described above, the apparatus of the present invention readily enables a positive or negative image of an original to be reproduced in response to simple change-over between the latent image formation processes.

Moreover, both negative and positive images of the original can be well developed by a single type of developer and this leads to the possibility of uniform and good image reproduction. Furthermore the construction of the apparatus is substantially similar to that of conventional apparatus directed to the reproduction of a single type of image, without involving any greater space or more complicated operation as compared with the latter.

I claim:

1. An image forming apparatus for selectively reproducing positive and negative electrostatic latent images corresponding to an original image, comprising:

a photosensitive medium having an insulating layer on the surface thereof;

first charger means capable of uniformly imparting charges to the surface of said photosensitive medium;

second charger means capable of acting on said photosensitive medium in subsequence to the action of said first charger means;

image exposure means for projecting the original image to expose said photosensitive medium to said image;

third charger means optically open with respect to the projection-exposure of said original image by said image exposure means and capable of acting on said photosensitive medium simultaneously therewith;

uniform exposure means for imparting uniform exposure to said photosensitive medium; and control means for selectively controlling the operations of said second charger means and said third charger means, and for actuating said uniform exposure means in response to selection of said third charger means.

2. An image forming apparatus according to claim 1, wherein said second and third charger means are selectively connected with a common high voltage source by said control means.

3. An image forming apparatus for selectively reproducing positive and negative electrostatic latent images corresponding to an original image, comprising:

a photosensitive medium having an insulating layer on the surface thereof;

first charger means capable of uniformly imparting charges to the surface of said photosensitive medium;

optically open second charger means;

image exposure means for projecting the original image to expose said photosensitive medium to said image, said exposure means having a first exposure path acting on said photosensitive medium simultaneously with said second charger means and a second exposure path acting on said photosensitive medium in subsequence to said second charger means;

change-over means for changing over the exposure paths of said image exposure means;

uniform exposure means for imparting uniform exposure to said photosensitive medium; and control means for controlling the operations of said change-over means and said uniform exposure means.

4. An image forming apparatus according to claim 3, wherein said change-over means comprises a movable mirror.

5. An image forming apparatus according to claim 3, wherein said control means actuates said uniform exposure means when said first exposure path is selected by said change-over means.

6. An image forming exposure apparatus for selectively reproducing positive and negative electrostatic latent images corresponding to an original image, comprising:

a photosensitive medium having an insulating layer on the surface thereof;

first charger means capable of uniformly imparting charges to the surface of said photosensitive medium;

second charger means capable of acting on said photosensitive medium in subsequence to the action of said first charger means;

image exposure means for projecting the original image to expose said photosensitive medium to said image;

third charger means optically open with respect to the projection-exposure of said original image by said image exposure means and capable of acting on said photosensitive medium simultaneously therewith;

uniform exposure means for imparting uniform exposure to said photosensitive medium;

developing means for supplying developer to said photosensitive medium; and control means for selectively actuating said second and third charger means, and for actuating said uniform exposure means when said third charger means is selected.

7. An image forming apparatus for selectively reproducing positive and negative electrostatic latent images corresponding to an original image, comprising:

a photosensitive medium having an insulating layer on the surface thereof;

first charger means capable of uniformly imparting charges to the surface of said photosensitive medium;

optically open second charger means;

image exposure means for projecting the original image to expose said photosensitive medium to said image, said exposure means having a first exposure path acting on said photosensitive medium simultaneously with said second charger means and a second exposure path acting on said photosensitive medium in subsequence to said second charger means;

change-over means for changing over the exposure paths of said image exposure means;

uniform exposure means for imparting uniform exposure to said photosensitive medium;

developing means for supplying developer to said photosensitive medium; and control means for actuating said uniform exposure means in accordance with the selection of said first exposure path by said change-over means.

* * * * *